United States Patent [19]

Wyatt

[11] 4,063,338

[45] Dec. 20, 1977

[54] STRAND TREATMENT METHOD AND APPARATUS

[75] Inventor: William Kirk Wyatt, West Chester, Pa.

[73] Assignee: Textured Yarn Co., Inc., Kennett Square, Pa.

[21] Appl. No.: 633,594

[22] Filed: Nov. 19, 1975

[51] Int. Cl.[2] ..... D02G 1/12; D02G 1/16

[52] U.S. Cl. ..... 28/221; 28/266; 28/274

[58] Field of Search ..... 28/1.4, 72.12, 1.3, 28/1.6, 72.11, 72.14, 220, 221, 265, 266, 275, 276, 277; 57/34 B, 157 F; 226/7, 97; 302/25, 63

[56] References Cited

U.S. PATENT DOCUMENTS

| | | | |
|---|---|---|---|
| 3,110,151 | 11/1963 | Bunting et al. | 28/1.4 X |
| 3,220,082 | 11/1965 | Fletcher et al. | 28/1.4 |
| 3,237,269 | 3/1966 | Hawkins | 28/1.4 |
| 3,501,819 | 3/1970 | Satterwhite | 28/1.3 |
| 3,530,660 | 9/1970 | Kirchner et al. | 57/157 F |
| 3,681,821 | 8/1972 | Buck | 28/1.3 |
| 3,898,719 | 8/1975 | Lloyd | 28/1.4 |
| 3,946,468 | 3/1976 | Satterwhite | 28/72.11 |

*Primary Examiner*—Louis K. Rimrodt
*Attorney, Agent, or Firm*—Miller & Prestia

[57] ABSTRACT

Textile strand stabilization by filament interlacing is provided by means of jet apparatus having a longitudinal strand-receiving bore intercepted by at least one fluid-receiving bore substantially perpendicular thereto and to its minor transverse axis. Fluid injected into the fluid-receiving bore establishes within the longitudinal bore a vortex-like flow configuration substantially perpendicular to the longitudinal axis and to the minor transverse axis of the longitudinal bore. The apparatus preferably has a plurality of fluid-receiving bores offset along the longitudinal axis by distances up to the width of a fluid receiving bore.

22 Claims, 7 Drawing Figures

STRAND TREATMENT METHOD AND APPARATUS

This invention relates to stabilization of textile strand without the necessity of imparting twist thereto, especially by treating a multifilament strand in fluid jet apparatus to interlace the component filaments.

Jet apparatus for fluid treatment of textile strands to improve their integrity without twisting are well known, as in U.S. Pat. Nos. 3,364,537 (Bunting and Nelson), 3,083,523 (Dahlstrom and West), and 3,426,406 (McCutchan), for example. However, they rely upon relatively wild fluid turbulence, as in whipping the component filaments of a multifilament strand about the strand axis. Fluid consumption in such apparatus and procedure is very considerable.

A primary object of the present invention is fluid treatment of textile strands for improved stabilization of the strand configuration.

Another object is such strand treatment at desirably low consumption of treating fluid.

A further object is such strand treatment at desirably low fluid pressure.

Other objects of this invention, together with means and methods for attaining the various objects, will be apparent from the following description and the accompanying diagrams.

In general, the objects of the present invention are accomplished, in the interlacing of a running textile strand by fluid treatment within a region of temporary confinement, by confining the strand more closely in one lateral dimension perpendicular to the running direction than in the lateral dimension perpendicular thereto, and directing a stream of fluid onto the strand substantially perpendicular to the running direction and along the bisector of the more closely confining lateral dimension, preferably a plurality of such streams from opposite sides and offset slightly from one another in the running direction.

Specifically, apparatus for interlacing the filaments of a multifilament textile strand according to this invention may comprise a housing with a longitudinal strand-receiving bore therethrough having a substantially rectangular cross-section having major and minor transverse axes, a plurality of fluid-receiving bores intersecting the longitudinal bore from opposite sides perpendicular thereto and to the minor axis, the loci of intersection of the fluid-receiving bores with the longitudinal bore being offset along the longitudinal bore a distance up to the width of such a fluid-receiving bore.

Figure 1:
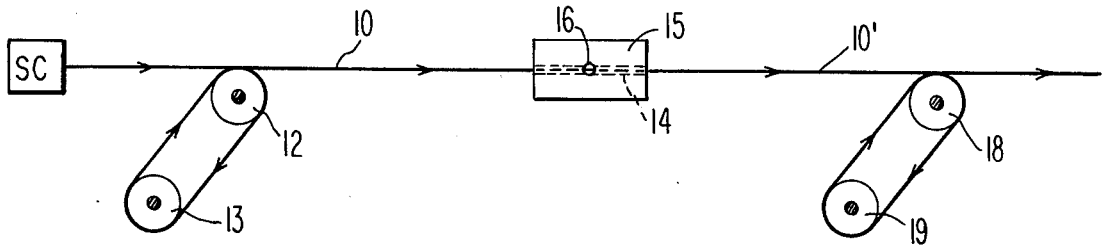
FIG. 1 is a schematic side elevation of apparatus for practicing the present invention, with a strand running therethrough.
Figure 2:
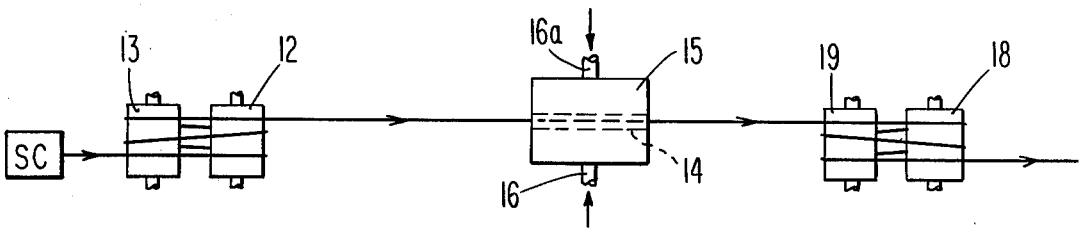
FIG. 2 is a schematic plan view of the apparatus of FIG. 1, with the strand.
Figure 3:
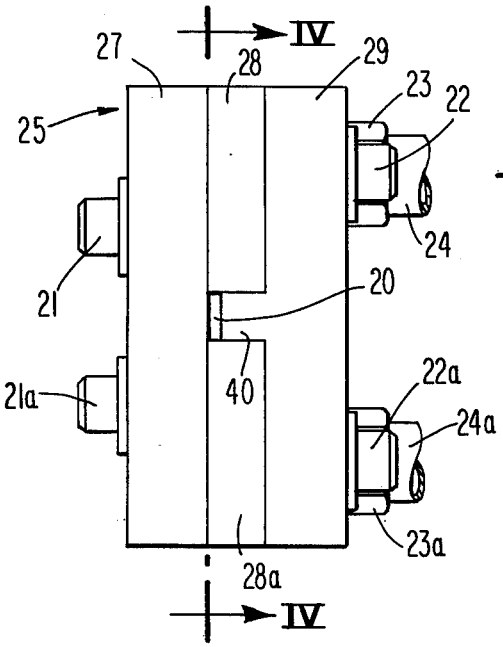
FIG. 3 is an end elevation of jet apparatus of this invention fully assembled.
Figure 4:
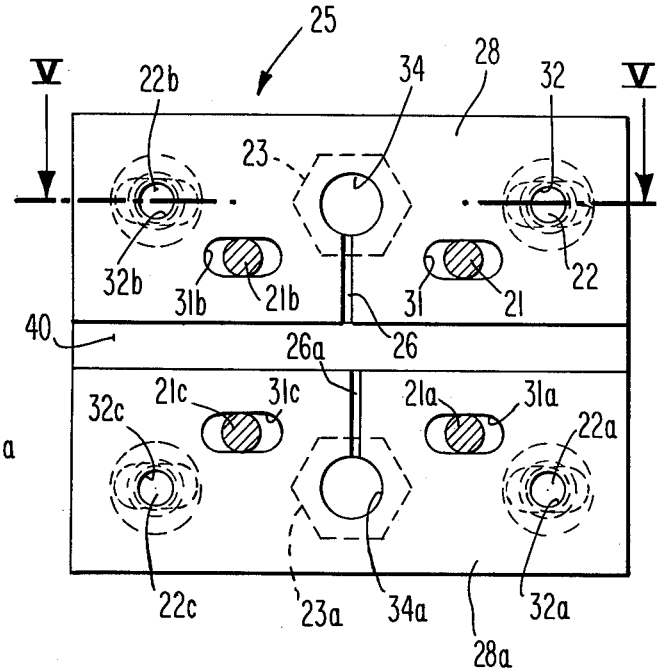
FIG. 4 is a medial transverse section through the apparatus of the preceding view, taken at IV—IV thereon.
Figure 5:
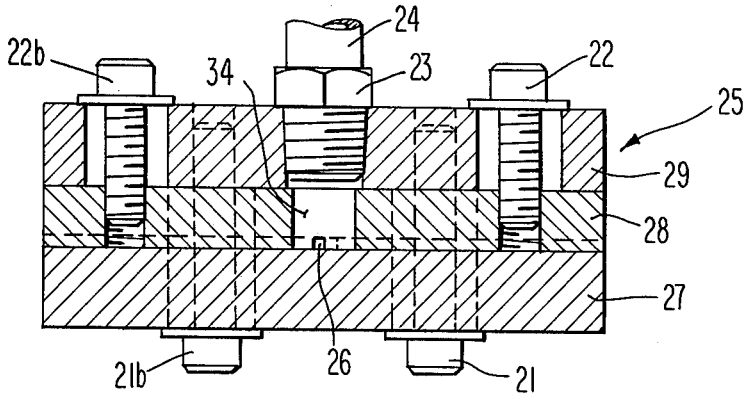
FIG. 5 is an off-axial longitudinal section through the same apparatus, taken at V—V in FIG. 4.

FIGS. 1 and 2 show in schematic elevation and plan, respectively, textile strand 10 exiting from stuffer crimper SC (shown diagrammatically) and passing successively about upstream pair of godet rolls 12 and 13, through longitudinal bore 14 (indicated in broken lines) of treating jet apparatus 15, and about downstream pair of godet rolls 18 and 19, the strand downstream of the jet apparatus being designated as 10'. Transverse fluid inlet tubes 16, **16*a*** on opposite sides feed transverse bores (not shown) intersecting the longitudinal bore substantially perpendicularly. Although not readily apparent from those schematic views, the lateral or transverse dimensions of the longitudinal bore are dissimilar in the respective views because the bore has a rectangular cross-section.

It will be understood that the strand makes enough wraps about the upstream and downstream godets to assure essentially non-slipping contact therewith and resulting control in rate of input to and withdrawal from the jet apparatus, one of the rolls in each pair customarily being driven at desired speed of rotation. The withdrawal speed should be somewhat less than the input speed, perhaps 80 to 90% thereof to allow for reduction in effective length via interlacing and likely shrinkage where, as is preferred, the treating fluid is hot enough to effect heat relaxation. These conventional aspects of interlacing means and methods do not form part of this invention although useful in its practice.

FIGS. 3 to 6 show actual jet apparatus 25, as distinguished from the schematic jet apparatus of the preceding views. Cover plate 27 and backing plate 29 sandwich pair of intermediate plates 28, **28*a* spaced by boss 40 on the backing plate. Bolts 21, 21*a*, 21*b*, 21*c* pass through elliptical slots 11, 11*a*, 11*b*, 11*c* in the cover plate and similar slots 31, 31*b* in intermediate plate 28 and slots 31*a*, 31*c* in intermediate plate 28*a* to thread into the backing plate at 41, 41*a*, 41*b*, and 41*c*, respectively. Likewise, bolts 22, 22*a*, 22*b*, 22*c* pass through elliptical openings 42, 42*a*, 42*b*, 42*c* in the backing plate and into intermediate plate 28 at 32, 32*b* and intermediate plate 28*a* at 32*a*, 32*c*. Tubes 24, 24*a* terminate in hex fittings 23, 23*a* threading into the backing plate from the rear at 44, 44*a* and communicate with transverse slots 26, 26*a* through openings 34, 34*a* intervening in the respective intermediate plates. These tubes correspond to fluid inlet tubes 16, 16*a*** shown schematically in FIG. 2 as extending laterally from the jet apparatus.

Figure 7:
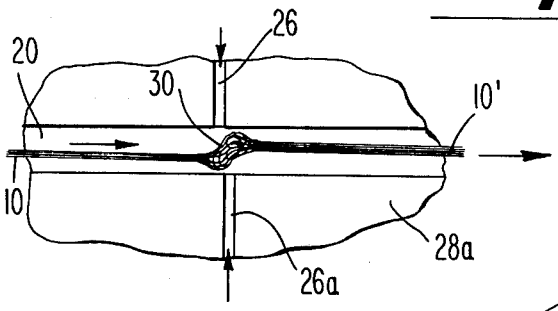
FIG. 7 is a schematized view of strand being treated in such jet apparatus of this invention.
Figure 6:
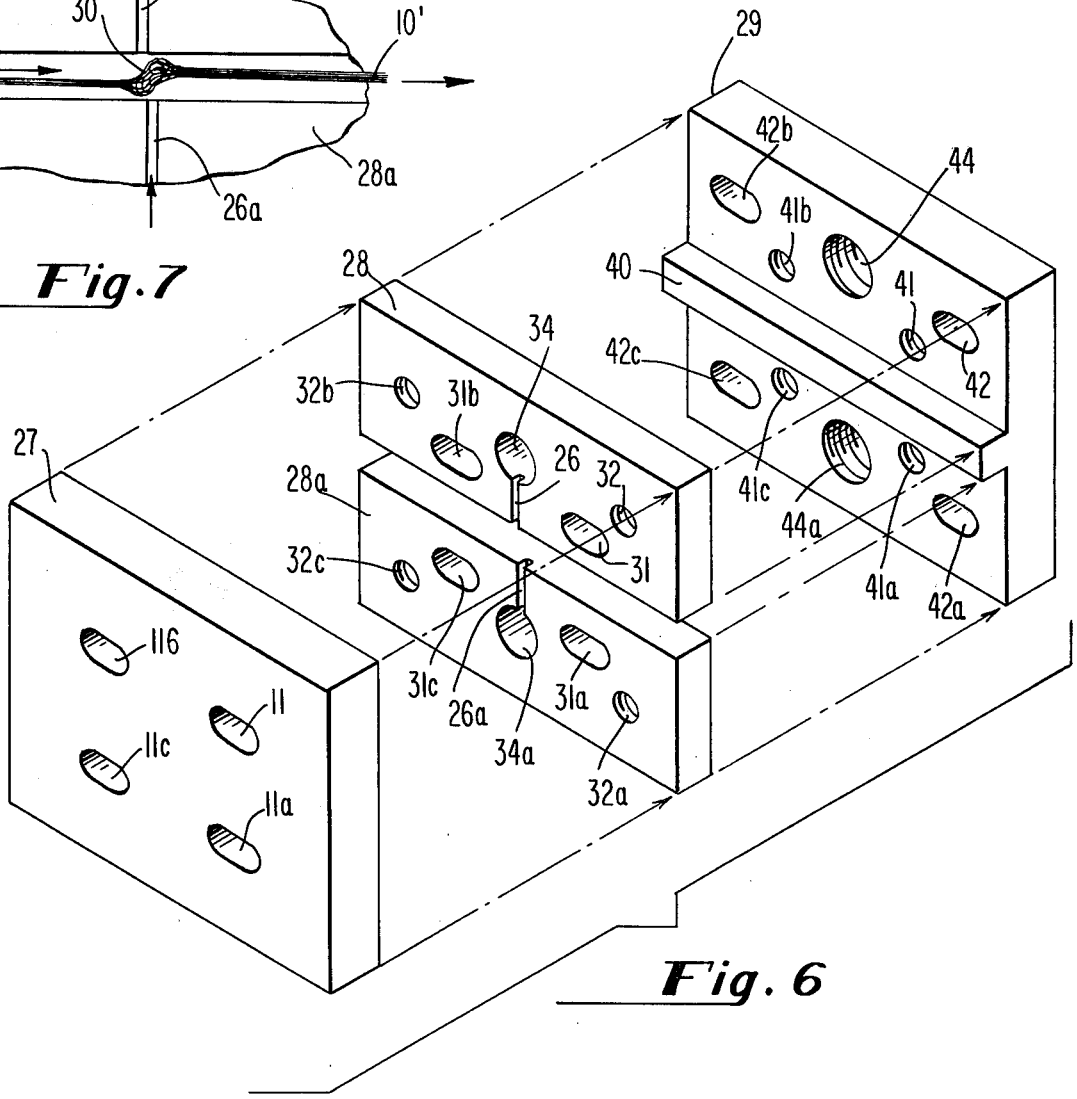
FIG. 6 is an exploded view of the apparatus of FIGS. 3, 4, and 5, less retaining means.

FIG. 7 shows somewhat schematically the appearance of a multifilament textile strand being treated in such jet apparatus of this invention. Incoming strand 10 running through longitudinal bore 20 is deflected downward by the flow of fluid from transverse bore 26 in intermediate plate 28 and then is deflected upward by the flow of fluid from transverse bore **26*a* in intermediate plate 28*a*,** the respective transverse bores being offset from one another at their perpendicular intersection with the longitudinal bore by a distance up to approximately one diameter or width of such a transverse bore. The action upon the strand is to force it vortically in an S-shaped pattern lying in the longitudinal bore parallelling its minor transverse dimension with the arms of the S extending outward in the major transverse dimension of the longitudinal bore. If one transverse bore is absent, blocked, or the fluid supply to it interrupted, a single or simple vortex of fluid is established in such plane, with similar but lesser interlacing results, and a plurality of such bores so offset from one another is preferred. This action is readily distinguished from prior art methods utilizing longitudinal bores with rounded walls and lacking the wall spacing aspect ratio of the present invention, according to which the major transverse dimension of the longitudinal bore is several times as large as its minor transverse dimension.

The apparatus and method of this invention are especially useful in interlacing stuffer-crimped multifilament textile strands wherein filaments tend to become disarranged or to migrate because of the crimp configuration, as in adjacent wraps on a package or in winding operations. Stuffer crimping apparatus is well known in the art as evidenced by U.S. Pat. Nos. 3,027,619 (List et al); 3,279,025 (Stanley); 3,753,275 (Stanley) and 3,491,420 (Stanley). The apparatus and method of the present invention can be advantageously employed downstream from such stuffer crimpers. An example of use thereof on such strands is given below, and strand crimped otherwise will also benefit therefrom, as will uncrimped strands, especially those having little or no twist or false twist therein.

Advantages of the present method include reduction of fluid consumption and/or fluid pressure below what would be required by interlacing jets in the prior art. Thus, even for a stuffer-crimped 68-filament 6-nylon strand (original denier 3650, drawn 3X) treated at about 600 meters per minute, excellent interlacing was obtained at a consumption of 1 to 3 standard cubic feed of air per minute at pressure between 60 and 75 pounds per square inch. Suitable rectangular bore dimensions for so treating such strands are about ¼ inch by 1/16 inch, and suitable transverse bore diameter (or width, if not round) several hundredths of an inch. The transverse bore diameter (or width) should not exceed the minor axis dimension of the longitudinal bore. The offset of adjacent transverse bores when using a plurality thereof should not exceed the transverse bore diameter (or width) and preferably should be at least a major fraction thereof. More than two transverse bores may be used, located alternately on opposite sides, of course, but there is much less incremental advantage in doing so than in using two instead of one thereof. Dimensions of the jet apparatus will depend upon the strand denier of course, and the optimum may be determined by simple trial. Conventional materials of construction are adequate.

Although this invention has been described and illustrated with special reference to a particular apparatus embodiment, some variations have been mentioned. Additional modifications may be made, as by adding, combining, or subdividing parts or steps, or by substituting equivalents, while retaining many of the benefits of the invention, which itself is defined in the following claims.

The claimed invention is:

1. Method of interlacing the filaments of a multifilament textile strand, comprising running the strand lengthwise past an interlacing locus, confining the strand circumferentially at the interlacing location and subjecting the strand at the interlacing locus to a fluid stream substantially perpendicular to the running direction of the strand said strand being confined at least several times as closely in one lateral dimension as in the lateral dimension perpendicular thereto.

2. In the interlacing of a running textile strand by fluid treatment within a region of temporary lateral confinement, the improvement comprising confining the strand more closely in one lateral dimension perpendicular to the running direction than in the lateral dimension perpendicular thereto, and directing a stream of fluid onto the strand substantially perpendicular to the running direction and from along the bisector of the more closely confining lateral dimension.

3. Strand-interlacing method according to claim 2, wherein streams of fluid are so directed onto the strand from opposite sides.

4. Strand-interlacing method according to claim 3, wherein the streams of fluid are so directed oppositely onto the strand at loci offset from one another along the running direction.

5. Strand-interlacing method according to claim 4, wherein the offset along the running direction is at most about the width of either such stream of fluid therealong.

6. Strand-interlacing method according to claim 2, wherein the distance aspect ratio of the respective laterally confining dimensions is on the order of several to one.

7. Strand-interlacing method according to claim 6, wherein the width of such stream fluid along the running direction is at most equal to the dimension of closer lateral confinement.

8. Apparatus for interlacing textile strands comprising a housing with a longitudinal bore therethrough having a substantially rectangular cross-section, with the aspect ratio of the major lateral axis to the minor lateral axis being on the order of several to one, and a transverse bore intersecting the longitudinal bore substantially perpendicular thereto and to the minor axis thereof, the longitudinal bore being adapted to receive a running strand, and the transverse bore being adapted to receive fluid under pressure thereinto and to deliver it into the longitudinal bore and onto any strand therein.

9. Strand-interlacing apparatus according to claim 8, wherein such transverse bore is at most about as wide along the longitudinal bore at its intersection therewith as the length of the minor axis of the longitudinal bore perpendicular thereto.

10. Strand-interlacing apparatus according to claim 9, wherein the respective transverse bores are offset relative to one another along the longitudinal bore at their intersection therewith up to a distance approximating the width of such a transverse bore.

11. Strand-interlacing apparatus according to claim 10, wherein the offset distance is on the order of several hundredths of an inch.

12. Strand-interlacing apparatus according to claim 8, including a pair of such transverse bores intersecting the longitudinal bore from opposite sides.

13. Apparatus for interlacing the filaments of a multifilament textile strand, comprising a housing with a longitudinal strand-receiving bore therethrough having a substantially rectangular cross-section having major and minor transverse axes, a plurality of fluid-receiving bores intersecting the longitudinal bore from opposite sides perpendicular thereto and to the minor axis, the loci of intersection of the fluid-receiving bores with the longitudinal bore being offset along the longitudinal bore a distance up to the width of such a fluid-receiving bore.

14. In a method of interlacing a multifilament textile strand, the steps which comprise stuffer crimping the strand, running the stuffer crimped strand lengthwise past an interlacing locus, confining the strand circumferentially at the interlacing locus, and subjecting the strand to a fluid stream substantially perpendicular to the running direction of the strand whereby an interlacing effect is developed, said strand being confined at least several times as closely in one lateral dimension as in the lateral dimension perpendicular thereto.

15. A method of interlacing a multifilament textile strand according to claim 14, including precluding any substantial fluid vortex having its axis other than perpendicular to the running direction of the strand.

16. A method of texturizing a multifilament textile strand including crimping said strand and then running said crimped strand through a fluid treatment entangling means said step of running said crimped strand through a fluid treatment entangling means includes confining said strand more closely in one lateral dimension perpendicular to the running direction than in the lateral dimension perpendicular thereto and directing a stream of fluid onto the strand substantially perpendicular to the running direction and from along the bisector of the more closely confining lateral dimension.

17. A method as recited in claim 16, wherein streams of fluid are so directed onto the strand from opposite sides.

18. A method according to claim 17, wherein the streams of fluid are so directed oppositely onto the strand at loci offset from one another along the running direction.

19. A method according to claim 18, wherein the offset along the running direction is at most about the width of either such stream of fluid therealong.

20. A method according to claim 16, wherein the distance aspect ratio of the respective laterally confining dimensions is on the order of several to one.

21. A method according to claim 20, wherein the width of such stream of fluid along the running direction is at most equal to the dimension of closer lateral confinement.

22. A method of interlacing the filaments of a multifilament textile strand, comprising running the strand lengthwise through a longitudinal bore having a pair of intersecting transverse bores, deflecting the strand downwardly by the flow of fluid from a first transverse bore and then deflecting the strand upwardly by the flow of fluid through a second transverse bore, the respective transverse bores being offset from one another at their intersection with the longitudinal bore by a distance approximately one diameter of width of such transverse bore, whereby the strand is formed into an S-shaped configuration in the longitudinal bore.

* * * * *